United States Patent [19]

Legille et al.

[11] 4,152,243

[45] May 1, 1979

[54] TREATMENT OF BITUMINOUS SCHISTS

[75] Inventors: Edouard Legille, Luxembourg; René Mahr, Howald-Hespérange, both of Luxembourg

[73] Assignee: S.A. des Anciens Etablissements Paul Wurth, Luxembourg, Luxembourg

[21] Appl. No.: 822,344

[22] Filed: Aug. 5, 1977

[30] Foreign Application Priority Data

Aug. 13, 1976 [LU] Luxembourg ..... 75589

[51] Int. Cl.[2] ..... C01B 47/18; C10G 1/02

[52] U.S. Cl. ..... 208/8 R; 201/40; 202/262; 208/11 R

[58] Field of Search ..... 208/11 R, 8; 201/40; 202/262

[56] References Cited

U.S. PATENT DOCUMENTS

| | | | |
|---|---|---|---|
| 2,714,472 | 8/1955 | Richardson | 214/17 CA |
| 3,044,859 | 7/1962 | Parker | 208/11 R |
| 3,107,985 | 10/1963 | Huntington | 208/8 |
| 3,325,395 | 6/1967 | Ban | 208/8 |
| 3,693,812 | 9/1972 | Mahr et al. | 214/17 CB |
| 3,736,247 | 5/1973 | Jones et al. | 208/11 R |

FOREIGN PATENT DOCUMENTS

| | | | |
|---|---|---|---|
| 658956 | 4/1938 | Fed. Rep. of Germany | 202/662 |

*Primary Examiner*—Herbert Levine

[57] ABSTRACT

A process for treating bituminous schists including the steps of crushing the bituminous schist, feeding said schist to the top of a retort, pyrolyzing the crushed schist in said retort as it is moved downwardly therein through a combustion zone into which air is introduced, removing volatiles from the upper part of the retort, and removing spent schist from the bottom of the retort, said process being characterized by maintaining the combustion zone at a predetermined level in the retort by feeding the schist in a gradual and even manner.

6 Claims, 4 Drawing Figures

TREATMENT OF BITUMINOUS SCHISTS

The cost of mineral oil and the exhaustion of resources have made it economically advantageous to treat bituminous schists and sands. The only process which at present appears applicable on an industrial scale is one in which the volatile components, mainly the hydrocarbons, are separated from the schist. Therefore the schist must first undergo a crushing operation, followed by pyrolysis and distillation of the hydrocarbons and other volatile components. The exhausted schists are thereafter discarded.

Various processes and installations for such operations are already known. One widely used process is a process in which the schist is fed into a vertical furnace or retort from above and then moved down by mechanical means to the bottom of the retort, where it is evacuated. Some of the product emanating from the pyrolysis and distillation operation, preferably a gaseous fraction, is fed together with a corresponding quantity of air at a suitable level into the mass of schist in the retort, generally half-way up, and is burnt therein. This process creates a combustion zone which is limited by the quantity of air introduced and supplying the calories required for the pyrolysis and distillation of the bituminous schists in a pyrolysis and distillation zone situated above the combustion zone. The gaseous constituents contained in the schist are thus obtained in the pyrolysis and distillation zone at temperatures of the order of 500° C. and leave the retort in a direction opposite to that of the fresh schist fed into it after passing an upper zone serving as a schist drying zone.

On emerging from the retort the less volatile constituents are condensed and recuperated while the gases which are not condensable at the ordinary temperature undergo a final purification and are partly recycled to the combustion zone, the remainder being intended for use for other purposes.

The recycled gas may be subdivided into two separate flows, the first one being fed directly into the furnace at the level of the combustion zone, the admission of the second one taking place at the bottom of the retort, in order to effect a heat exchange as a means of re-cooling the exhausted schist coming from the combustion zone in a counter-flow to the fresh recycling gas rising towards the combustion zone.

The schist fed into the retort is usually in the form of a crumbly product having a granulometry resulting from the crushing operation and from which the fines have been separated. The retort, which is at a pressure slightly above atmospheric, receives the schist which consists essentially of a macroscopically homogeneous product via a sluice chamber. The recycled gas and the combustion air are fed in the retort according to the geometric configuration resulting from the devices provided for this purpose. In order to ensure satisfactory operation of the retort, a defined combustion zone should be established which will enable the economic efficiency of the installation to be increased to the maximum and a compromise must be found in the geometrical design of the admissions to the combustion zone for different operating conditions and different grades of schist being treated. It must nevertheless be borne in mind that it is particularly difficult to find a satisfactory compromise for retorts of which the diameter exceeds 10 meters inasmuch as the uneven heap formed by the schist fed into them may cause pressure losses, which vary according to the cross section of the retort and which will impede its operation.

Furthermore the dividing face between the combustion zone on the one hand and the pyrolysis and distillation zone on the other is subject to fluctuation and irregularities, making it difficult to regulate the operating conditions. The less volatile constituents are observed to condense on the upper layers of the schist which has just been fed into the retort and which is therefore cold, the condensates having to be re-evaporated during the operation of conveying the schists down to the bottom.

The dust contained in gases and vapours extracted from the plant must be separated and therefore quantity of the dust present should be as low as far as possible. However the charges at present fed to the retort are essentially discontinuous, causing numerous difficulties due to the presence of dust and to unsatisfactory distribution of the product. Certain plants are provided, in order to take this latter point into account, with vertical bars positioned in the head of the retort, but no practical general solution has so far been found for the various problems mentioned.

The purpose of the present invention is to ensure operation of a retort for the treatment of bituminous schist, enabling the volatile constituents to be extracted by a method enabling the operating conditions in the retort to be regulated as desired and in particular enabling the level of the combustion zone in the retort to be localized by suitable distribution of the schist in the retort.

The said object is achieved as a result of the fact that the crushed bituminous schist is fed in through a sluice chamber by means of a rotary distribution spout with a controlled angle of inclination. The schist can thus be fed from the chamber via the spout, which is caused to perform a rotatory movement in accordance with concentric circles or spirals, by modifying the angle of inclination of the said spout. It is thus possible, by controlling the spout, to obtain any desired profile for the material fed in and thus to deliberately modify the pressure losses of the circulating gas constituents, in accordance with the cross section of the retort, according to the requirements which must be fulfilled in order to correct the operation of the retort and establish the rate of production which is desired.

In particular, the fresh schist can be fed into the retort in a gradual and even manner in order to prevent the excessive condensations which are at present caused by the sudden and almost instantaneous admission of a large mass of cold schist to be treated.

The driving mechanism for the spout enables the quantity of material fed in to be increased in a certain section or segment in order to locally modify the conditions under which the gases are circulating and thus correct the rate at which the plant is operating.

The major advantage of the invention resides essentially in the extreme precision with which it enables the schist to be distributed in accordance with a certain particular profile. In this case there is no longer any need to provide other devices for the purpose of ensuring the regular distribution of the material.

Furthermore, the use of a rotary spout with a variable angle of inclination, in accordance with the invention, makes it possible to slide the material from the admission sluice-chamber and to deposit it in a practically impact-free manner on the bed of schist to be treated. In particular, the use of a telescopic spout enables the schist to be deposited, practically without impacts, at all points on the surface of the said bed of material.

In one particularly advantageous embodiment of the process to which the invention relates the distribution of the material is controlled in accordance with the quantity and nature of the volatile products resulting from the process. For this purpose the parameters relating to the volatile products obtained are measured continuously or intermittently at a certain number of different points, the conditions under which the retort is fed being then modified, if necessary, in accordance with the results.

In another embodiment of the invention, which might be combined with the first, the distribution of schist through the spout is effected in accordance with the weight of schist taken from a storage bin.

It has been found that the gaseous fraction obtained in the operation and extracted partly for the purpose of recycling it to the combustion zone is equally suitable for insufflation into the driving mechanism of the spout, in order to eliminate the considerable dust deposits on this mechanism, which is positioned in the head of the retort, above the drying zone.

From a constructional point of view the invention relates to a retort for the treatment of bituminous schist, suitable for the extraction thereof, of the volatile constituents comprising at least one admission and feed sluice-chamber connected to a rotary distribution spout with a controlled angle of inclination, installed in the head of the retort.

The invention may advantageously include two admission and feed sluice-chambers serving as storage bins and capable of being used in turn for the purpose of feeding the spout.

The aforementioned sluice-chambers may be mounted on a weighing device enabling the quantity of material extracted to be ascertained in the course of the charging operation.

The present invention may be better understood and its objects and advantages will become apparent to those skilled in the art from the following description of a particularly preferred embodiment of the invention in reference to the accompanying drawings wherein;

FIG. 1 provides in full lines a diagram of a processing plant to which the invention applies and in broken lines a modification made in accordance with the invention to the circuits for the circulation of the gaseous products.

Figure 1:
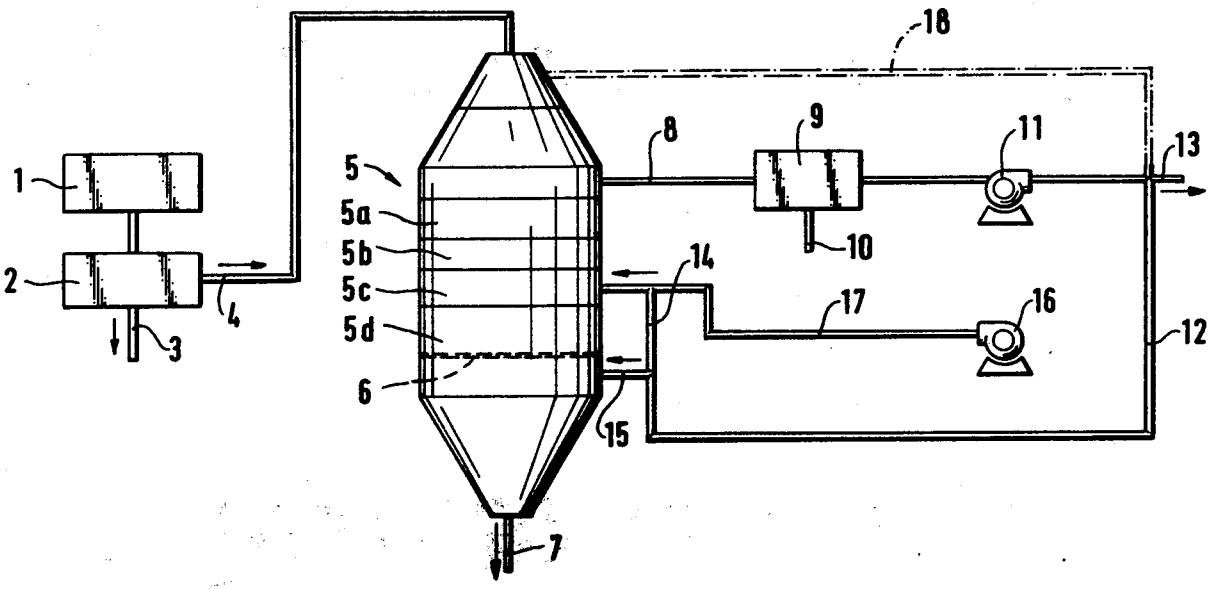

FIG. 1 shows, in full lines, a conventional installation of the known type for the treatment of bituminous schist. The schist extracted from the mine 1 undergoes a crushing operation in two stages at 2. The fines are rejected at 3 while the schist to be treated and having the desired granulometry circulates by means of a conveyor 4 and is fed from the top into a retort 5.

This retort is subdivided into a schist drying zone 5*a* and a pyrolysis and distillation zone 5*b*, which is followed by the combustion zone 5*c*. The schist moving from the top downwards then passes into a heat exchange zone and is finally extracted at 7, via a grid 6.

The volatile constituents and the dust carried along with the schist emerge from the furnace 5 in the position marked 8 and are collected in an installation 9 where the condensable fraction, of composition substantially similar to that of mineral oil, is extracted at 10. The gases which are not condensable at the ordinary temperature undergo a final purification and are extracted by a blowing unit 11, after which they divide up into two separate flows. The first flow 12 is recycled, while the second flow 13 is put to other uses. The current 12, in its turn, is subdivided into a flow 15, which enters the retort at the bottom and which heats up when in contact with solid substances (exhausted schist) descending in the zone 5*d*, the other fraction 14 is admitted directly, mixed with the air emanating from the conduit 17, and blown in by the fan 16.

Figure 2:
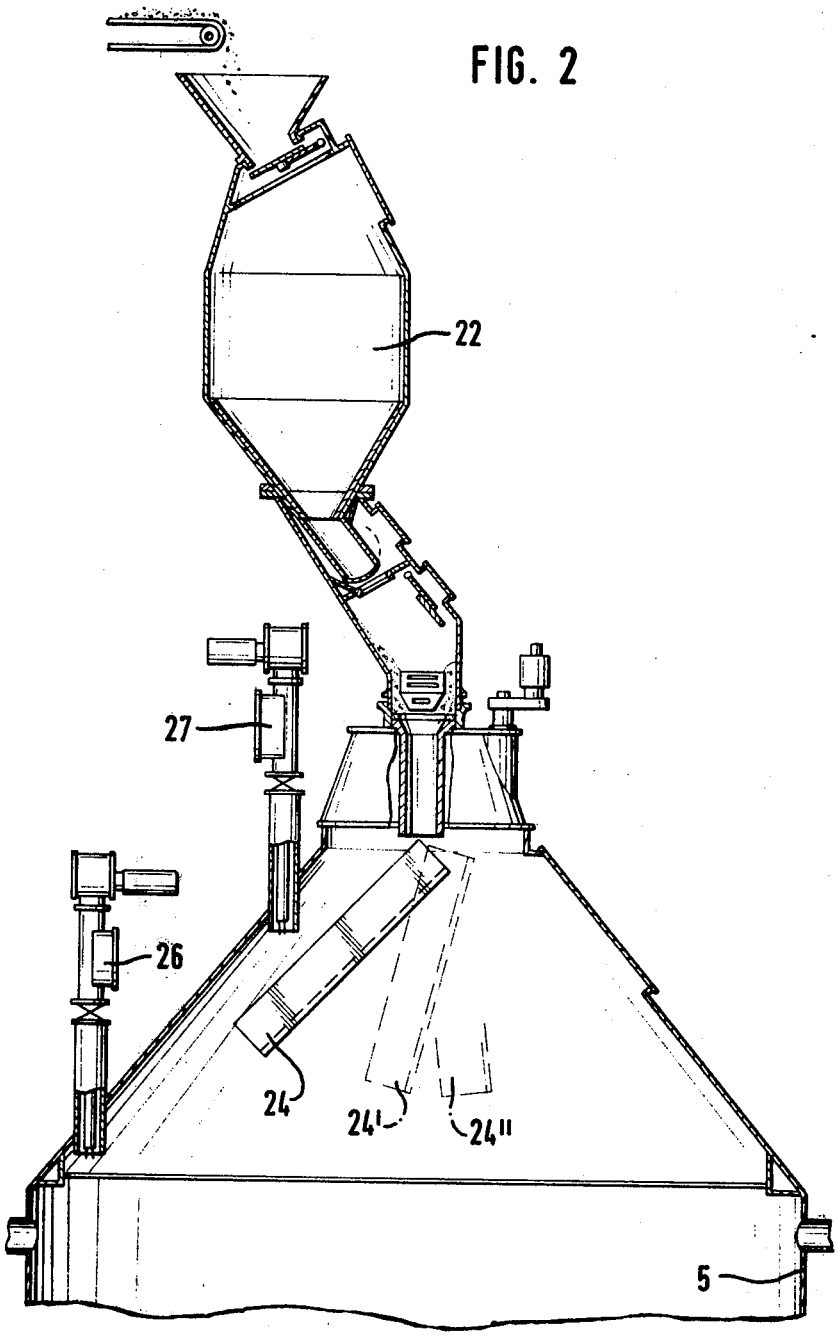
FIG. 2 shows a detail of the plant of FIG. 1 and illustrates the rotary spout with a controlled angle of inclination in accordance with the invention in an elevation of a retort head.

As there is a certain particular geometrical location for the admission of the mixture of air and gas recycled by the conduit 14, and as the schist fed to the retort is macroscopically homogeneous, the known installations provide no practical means of establishing a suitable profile for different operating conditions and for the varying grades of schist fed in, in order to create a suitable combustion zone, the only policy followed being therefore that of depositing the schist in as "flat" a manner as possible. It may be necessary, however, if optimum production is to be obtained, to deposit the schist in a certain particular configuration, according to the geometrical construction of the retort, the arrangement of the gas admission points to the combustion zone and various other factors, among which mention may be made of the manner in which the treated schist is extracted. The device illustrated in FIG. 2 enables the said particular configuration to be obtained.

The retort head is equipped with more than one bin 22, forming a sluice-chamber for the admission of the schist. From the bin 22 the material flows down through a chute and various other devices, reaching the centre of a spout 24 which, in the drawings, is shown for purposes of illustration in three successive positions which it may assume (the spout being marked 24' and 24'' in the second and third position, although in all three positions it is naturally one and the same spout that is shown). A control device (not shown in the drawing) enables the spout 24 to be set in rotation in accordance with the longitudinal axis of the retort 5 and to modify the angle of inclination of the spout. This makes it possible for the fresh schist being fed in to be poured onto the existing layer of schist underneath without any impacts and without an actual fall, despite the considerable height involved. Furthermore, vertical probes 26 and 27 enable the level which the material has reached to be ascertained before pouring in fresh material and indicate after this latter operation, whether it has been correctly carried out. Needless to say, the spout must be adjusted e.g. to the vertical position marked 24'' if the probe 27 is to function.

The charging device provided by the present invention also enables a central probe to be installed, with which the level of material across the central feed chute can be verified when the spout occupies the vertical position marked 24''.

The use of the spout not only enables the material to be distributed in the desired manner, thereby positionning the location of the combustion zone, but also considerably reduces the heights from which the material has to fall, thus likewise reducing the amount of dust formed, the latter presenting a particular obstacle to the subsequent separation of the hydrocarbons.

Figure 3:
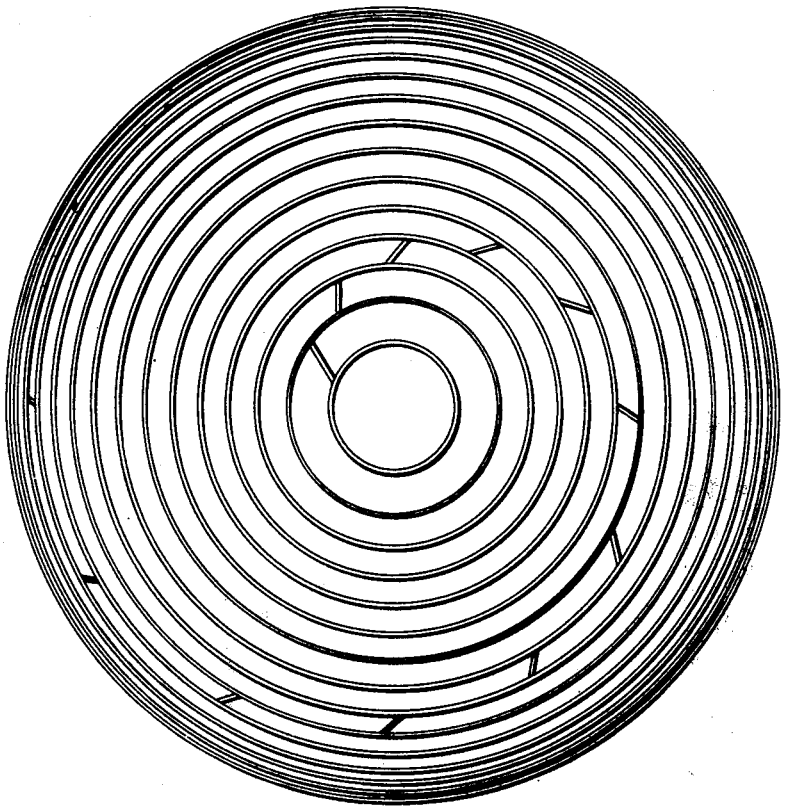
FIGS. 3 and 4 show, in a plan view and in a vertical section respectively, the way in which the schist can be deposited on the upper part of the schist which is present in the retort and which is to be treated.
Figure 4:
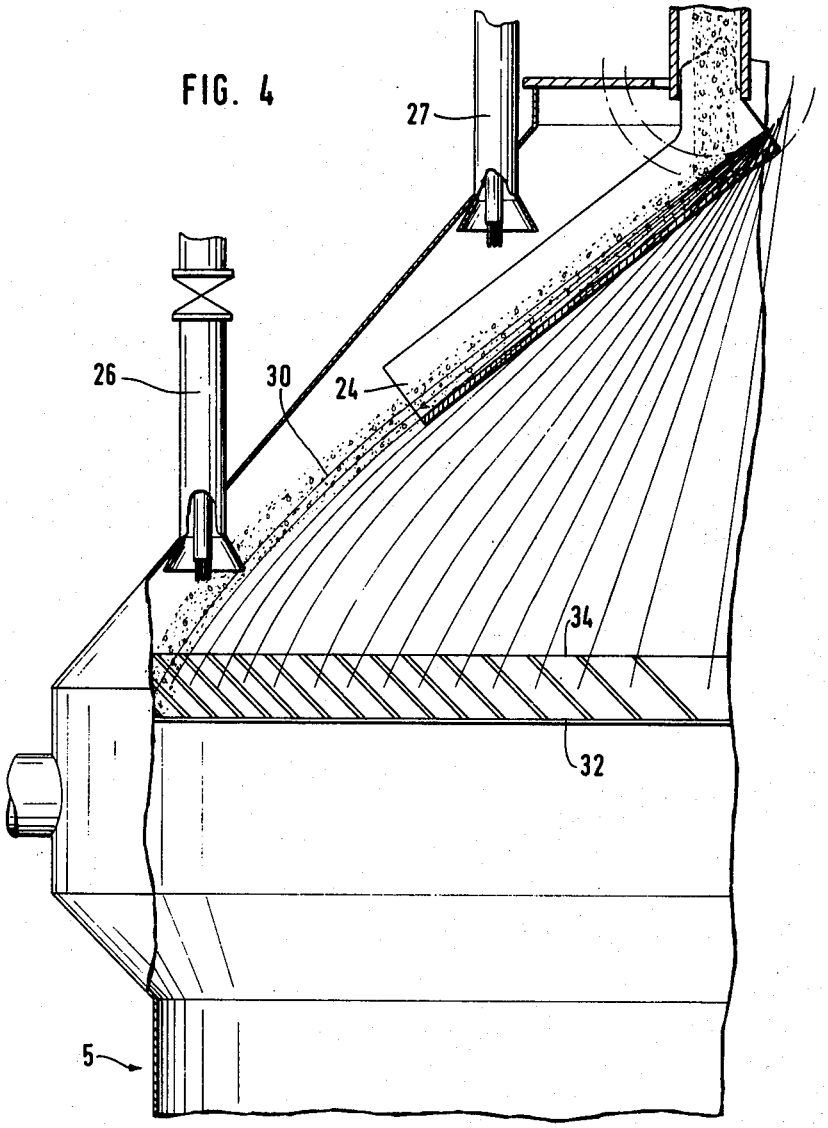

FIGS. 3 and 4 show the way in which the material can be distributed over the bed of schist situated in the drying zone 5*a*. It may be seen that the material 30, flowing through the spout 24, deposits itself in concentric layers of a predetermined thickness from an initial level 32 as far as the final level 34. Needless to say, it is perfectly possible for the material to be deposited in accordance with some other profiles than the essentially horizontal one shown here, and in many cases it may be of particular advantage to adopt a non-horizontal profile.

In FIG. 3 it may be seen that the material is deposited in concentric rings, the spout "jumping" each time in order to adjust itself in accordance with the adjacent ring. To ensure that the material will be deposited to a uniform height over the entire cross section of the retort, the width of the rings must be in inverse proportion to their radius, so that all the rings have the same area. This is the reason why the width of the rings shown in FIG. 3 decreases at an even rate from the center to the periphery of the retort.

The operation of feeding the material to the retort in accordance with the weight of material already deposited is rendered possible by equipping the bin 22 with a weighing device. This feed operation can also be effected in accordance with the results of the analysis of the gaseous products extracted from the schist.

To ensure an even distribution of the schist it may be of advantage to provide two storage bins each supplying the schist to the spout in turn, one of them discharging while the other is being filled.

In view of the by no means negligible quantity of dust present in the head of the retort, even though the use of the spout enables a violent fall of material to be avoided in the pouring operation, it has also been found of advantage to circulate a current of gas through the control mechanism of the spout. It has been found that the gas obtained after the condensation of the heavy fractions is particularly suitable for this purpose, and in accordance with the invention some of this gas (shown at 18 in FIG. 1) is recycled at the head of the retort 5.

Although a description has been provided of versions of the invention to which particular preference is given, many modifications can naturally be made to its method of operation and its construction, without departing from the scope of the invention.

What we claim is:

1. In a process for the treatment of bituminous schists in order to extract their volatile constituents and including the steps of:

(a) crushing the bituminous schist, (b) pyrolyzing the crushed bituminous schist by, (1) feeding said schist to the top of a retort, said retort having a combustion zone in the lower portion thereof, a pyrolysis zone above said combustion zone and a drying zone above said pyrolysis zone.

(2) moving said schist downwardly in said retort (3) introducing air into said combustion zone to generate said volatile constituents in said pyrolysis zone.

(c) conducting said volatile constituents from the upper end of said retort (d) and removing spent bituminous schist material from the bottom of said retort, the improvement which comprises maintaining said combustion zone at a predetermined level in said retort by feeding the schist to said retort in a gradual and even manner by cascading crushed bituminous schist along a single downwardly inclined pathway defined by a chute rotatable about a vertical axis to deposit in an arcuate track onto the top of the schist present in said retort a portion of the total of the crushed schist to be added, and adjusting the angle of inclination of said pathway and rotating said pathway while cascading crushed bituminous schist therealong to deposit a further portion of the total crushed schist to be added along a different arcuate track, said schist being deposited in concentric rings of uniform height and wherein the width of the rings is changed at an even rate at each incremented radius of chute rotation toward or away from the periphery of the retort whereby the area occupied by each ring is the same.

2. A process in accordance with claim 1 wherein a first portion of the volatile gases noncondensable at ordinary temperatures is recycled to the combustion zone in said retort.

3. A process in accordance with claim 2 wherein said first portion of the volatile gases noncondensable at ordinary temperatures is blended with air prior to introduction into said combustion zone.

4. A process in accordance with claim 1 wherein a second portion of the volatile gases noncondensable at ordinary temperatures is recycled to the bottom of the retort.

5. A process in accordance with claim 1 wherein a portion of the volatile gases condensable at ordinary temperatures is recycled to the head of the retort above the drying zone to eliminate considerable dust deposits in that region of the retort.

6. A process in accordance with claim 1 wherein the schist is deposited in concentric rings of uniform height and wherein the width of the rings is decreased at an even rate from the center outwardly to the periphery of the retort whereby the area occupied by each ring is the same.

* * * * *